US005800972A

United States Patent [19]

Kotani et al.

[11] Patent Number: 5,800,972

[45] Date of Patent: Sep. 1, 1998

[54] FINE COMPOSITE POLYMER PARTICLES AND IMAGE RECORDING MATERIAL BY USE THEREOF

[75] Inventors: Chiaki Kotani; Kiyokazu Morita; Eiichi Ueda; Yasuo Kurachi, all of Hino, Japan

[73] Assignee: Konica Corporation, Tokyo, Japan

[21] Appl. No.: 738,310

[22] Filed: Oct. 25, 1996

[30] Foreign Application Priority Data

Oct. 31, 1995 [JP] Japan ..... 7-283354

[51] Int. Cl.[6] ..... G03C 1/76

[52] U.S. Cl. ..... 430/531; 430/523; 430/536; 430/537; 430/631; 430/950; 430/961; 430/138; 430/107; 430/110; 430/496

[58] Field of Search ..... 430/523, 531, 430/536, 537, 631, 950, 961, 138, 107, 110, 496

[56] References Cited

U.S. PATENT DOCUMENTS 4,914,012 4/1990 Kawai ..... 430/536
5,550,011 8/1996 Fant et al. ..... 430/523
5,633,114 5/1997 Waterman ..... 430/961

FOREIGN PATENT DOCUMENTS 0 595 273 A1 5/1994 European Pat. Off. .
0 595 274 A1 5/1994 European Pat. Off. .

*Primary Examiner*—Geraldine Letscher
*Attorney, Agent, or Firm*—Frishauf, Holtz, Goodman, Langer & Chick, P.C.

[57] ABSTRACT

An image recording material improved in its physical property is disclosed, comprising composite polymer particles which comprise inorganic particles and a hydrophobic polymer compound containing a repeating unit represented by the following formula. The composite polymer particles are formed by polymerizing, in the presence of the inorganic particles, a composition containing a hydrophobic monomer.

15 Claims, No Drawings

FINE COMPOSITE POLYMER PARTICLES AND IMAGE RECORDING MATERIAL BY USE THEREOF

FIELD OF THE INVENTION

The present invention relates to composite polymer particles and an image recording material by use thereof.

BACKGROUND OF THE INVENTION

In the component layers of an image recording material (e.g., a subbed layer and a hydrophilic colloidal layer of a silver halide photographic light-sensitive material) are generally required physical properties of film, such as film-forming property (e.g., coatability), adhesive property, dimensional stability, flexibility, pressure resistance and drying property as well as no adverse effect on image characteristics. In the case of silver halide photographic light sensitive material (hereinafter, also referred to as photographic material), when coating a hydrophilic colloidal layer such as a silver halide emulsion layer, an interlayer or protective layer on a support, various attempts for improving physical properties of the film such as dimensional stability, scratch strength, flexibility, pressure resistance and drying property have been made by incorporating a polymer latex or colloidal silica in the hydrophilic colloidal layer.

From such a viewpoint, proposed has been the use of polymer latex of vinyl acetate, as disclosed in U.S. Pat. No. 2,376,005; the use of polymer latex of alkylacrylate, as disclosed in U.S. Pat. No. 3,325,286; the use of latices of polymer of n-butylacrylate, ethylacrylate, styrene, butadiene, vinyl acetate or acrylonitrile, as disclosed on Japanese Patent 45-5331; the use of polymer latex of alkylacrylate, acrylic acid or sulfoalkylacrylate, as disclosed in Japanese Patent 46-22506; the use of polymer latex of 2-acrylamido-2-methylpropanesulfonic acid, as disclosed in JP-A 51-130217 (herein, the term "JP-A" means published, unexamined Japanese Patent Application); the use of colloidal silica, as disclosed in Japanese Patent 47-50723 and JP-A 61-140939; and the use of composite latex composed of acrylate ester and colloidal silica, as disclosed in JP-A 61-236544. These polymer latices and colloidal silica, however, were proved to be poor in miscibility with hydrophilic colloid, resulting in problems such that a large addition amount resulted in deterioration in coatability, lowering in interlayer adhesion strength, deterioration in antiabrasion, cracking of the photographic material under dry conditions and overall deterioration in photographic performance.

The use of composite latex composed of acrylic acid ester and colloidal silica described in JP-A 1-177033 reduced occurrence of cracking some extent. However, it cannot be added in large amounts due to its poor miscibility with hydrophilic colloids, causing problems such as deterioration in antiabrasion in processing and photographic performance.

SUMMARY OF THE INVENTION

In view of the foregoing circumstances, the present invention was accomplished and an objective of the invention is improvement in physical properties of films by preventing cracking without adversely affecting image characteristics and deterioration in coatability.

The objective of the present invention can be accomplished by:

fine composite polymer particles comprising fine inorganic particles and a hydrophobic polymer compound having a repeating unit represented by the following formula (1),

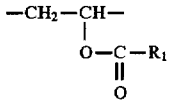

formula (1)

where $R_1$ represents a substituent;

the fine composite polymer particles formed by polymerizing, in the presence of fine inorganic particles, a composition containing a hydrophobic monomer represented by the following formula (2),

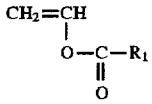

formula (2)

where $R_1$ has the same definition as in the above formula (1); the hydrophobic polymer compound having at least 45% by weight of the repeating unit represented by formula (1); the polymerizing composition containing hydrophobic monomers represented by formula (2) of at least 45% by weight of the total monomers; and an image recording material comprising said fine composite polymer particles.

DETAILED DESCRIPTION OF THE INVENTION

The fine inorganic particles used in the invention includes an inorganic oxide, nitride, and sulfide; and among these is preferred the oxide. Specifically is preferred an oxide of Si, Na, K, Ca, Ba, Al, Zn, Fe, Cu, Sn, In, W, Y, Sb, Mn, Ga, V, Nb, Tu, Ag, Bi, B, Mo, Ce, Cd, Mg, Be or Pb, in the form of a single oxide or compound oxide. In cases where the image recording material is a silver halide photographic light sensitive material, an oxide of Si, Y, Sn, Ti, Al, V, Sb, In, Mn, Ce or B, which is in the form of an single oxide or compound oxide, is preferred in view of its miscibility with an emulsion.

These oxides each may be crystalline or noncrystalline, preferably noncrystalline. The fine inorganic particles used in the invention have an average particle size of 0.5 to 3000 nm, preferably, 3 to 500 nm. The fine inorganic particles are used preferably in the form particles dispersed in water and/or water-soluble solvent. The fine inorganic particles are added in an amount of 1 to 2000% by weight, preferably, 30 to 1000% by weight, based on the hydrophobic polymer compound.

Examples of preferred oxides are shown as below.

| | | | |
|---|---|---|---|
| SO-1 | $SiO_2$ | SO-11 | $ZrSiO_4$ |
| SO-2 | $TiO_2$ | SO-12 | $CaWO_4$ |
| SO-3 | ZnO | SO-13 | $CaSiO_3$ |
| SO-4 | $SnO_2$ | SO-14 | $InO_2$ |
| SO-5 | $MnO_2$ | SO-15 | $SnSbO_2$ |
| SO-6 | $Fe_2O_3$ | SO-16 | $Sb_2O_5$ |
| SO-7 | $ZnSiO_4$ | SO-17 | $Nb_2O_5$ |
| SO-8 | $Al_2O_3$ | SO-18 | $Y_2O_3$ |
| SO-9 | $BeSiO_4$ | SO-19 | $CeO_2$ |
| SO-10 | $Al_2SiO_5$ | SO-20 | $Sb_2O_3$ |

Among these oxides, a silicon oxide is preferred and colloidal silica is more preferred.

The hydrophobic polymer compound used in the invention is referred to as one substantially insoluble in aqueous solution, such as a developing solution. More specifically, the hydrophobic polymer compound has a solubility of 3 g or less in 100 ml of water at 25° C.

In the afore-described formula (1) or (2), $R_1$ represents a substituent. The subsituent is preferably an alkyl group having 1 to 12 carbon atoms, more preferably, t-butyl group.

The hydrophobic monomer represented by formula (2) which forms the hydrophobic polymer compound is preferably vinyl esters and more preferably, vinyl pivalate, vinyl acetate, vinyl caproate and vinyl octylate. These monomer may be singly polymerized or copolymerized with plural vinyl esters or other copolymerizable monomer. In the case of copolymerization, crack can be effectively prevented by the use of not less than 45% by weight of the monomer represented by formula (2).

As a polymerization method is cited an emulsion polymerization method, solution polymerization method, block polymerization method, suspension polymerization method or radiation polymerization method.

Solution polymerization method:

A monomer composition with an optimal concentration in a solvent (usually, not more than 40%, preferably, 10 to 25% by weight, based on the solvent) is subjected to polymerization in the presence of an initiator at 10° to 200° C., preferably, 30° to 120° C. and for 0.5 to 48 hrs., preferably, 2 to 20 hrs.

The initiator can be optionally employed, if soluble in a polymerization solvent. Examples thereof are an organic solvent-soluble initiator such as ammonium persulfate (APS), benzoyl peroxide, azobisisobutylonitrile (AIBN) and di-t-butyl peroxide; water-soluble initiator such as potassium peroxide and 2,2'-azobis-(2-amidinopropane)-hydrochloride; and a redox type polymerization initiator, in which the above initiator is combined with a reducing agent such as a $Fe^{2+}$ salt or sodium hydrogensulfite.

The solvent is optional, if dissolves the monomer composition, including water, methanol, ethanol, dimethylsulfoxide, dimethylformamide, dioxane or a mixture thereof. After completing polymerization, the reaction mixture is poured into a solvent which does not dissolve the resulting polymer compound, to precipitate the product, followed by drying to remove unreacted composition.

Emulsion polymerization:

Using water as a solvent, a monomer of 1 to 50% by weight of water, an initiator of 0.05 to 5% by weight of the monomer and a dispersing agent of 0.1 to 5% by weight of water were subjected to polymerization at 30° to 100° C., preferably, 60° to 90° C. and for 3 to 8 hrs. with stirring.

As the initiator are usable a water-soluble initiator such as potassium peroxide, ammonium persulfate and 2,2'-azobis-(2-amidinopropane)-hydrochloride; and a redox type polymerization initiator, in which the above initiator is combined with a reducing agent such as a $Fe^{2+}$ salt or sodium hydrogensulfite. As the dispersing agent are usable an anionic surfactant, nonionic surfactant, cationic surfactant and amphoteric surfactant. Among these surfactant are preferably used an anionic surfactant and nonionic surfactant.

Exemplary examples of the fine composite polymer particles are shown as below. L-1 and L-6 were obtained in the different manner different, as described later.

| No. | Hydrophobic polymer compd. | Fine inorganic particles (wt. %, based on polymer) |
|---|---|---|
| L-1 | Vinyl pivalate | |
| L-2 | Vinyl pivalate (50 wt. %)<br>Vinyl caproate (50 wt. %) | Silicon oxide* (300) |
| L-3 | Vinyl pivalate (50 wt. %)<br>Vinyl acetate (50 wt. %) | Silicon oxide* (300) |

-continued

| No. | Hydrophobic polymer compd. | Fine inorganic particles (wt. %, based on polymer) |
|---|---|---|
| L-4 | Vinyl pivalate (30 wt. %)<br>Vinyl acetate (70 wt. %) | Silicon oxide* (300) |
| L-5 | Vinyl pivalate (70 wt. %)<br>Glycidylmethacrylate (30 wt. %) | Silicon oxide* (300) |
| L-6 | Vinyl pivalate | Silicon oxide* (300) |

(*: Silicon oxide in the form of collodial silica)

When the fine composite polymer particles are contained in the image recording material, the mean particle size (i.e., weight averaged diameter) is preferably 0.005 to 3.0 μm, more preferably, 0.01 to 0.8 μm.

In cases where the fine composite polymer particles of the invention are contained in at least one layer of an image recording material, the content thereof is preferably 2% or less by weight, based on a binder contained in the layer. Specifically, in cases where the fine composite polymer particles are contained in at least one component layer of a silver halide photographic light sensitive material, the content is preferably 2% or less by weight, based on gelatin contained in the component layer.

EXAMPLES

The present invention will be explain more in detail based on examples, but the embodiments of the invention are not limited thereto.

Example 1

Preparation example 1:

Preparation of fine composite polymer particles L-1

To 1000 ml four-necked flask provided with a stirrer, thermometer, dropping funnel, nitrogen gas-introducing tube and reflux condenser was introduced nitrogen gas to remove oxygen and then 360 cc of distilled water and 126 g of 30 wt. % colloidal silica dispersion (mean particle size, 12 nm) were added thereto and heated until an internal temperature reached 80° C. 1.3 g of a surfactant as shown below and 0.023 g of ammonium persulfate, as an initiator were added and then added 12.6 g of vinyl pivalate to continue the reaction further for 4 hrs. Thereafter, the reaction mixture was cooled and adjusted to the pH of 6 with an aqueous solution of sodium hydroxide to obtain the composite polymer particles L-1.

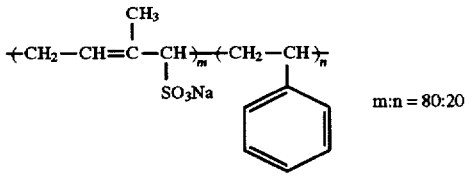

Composite polymer particles, L-2 through L-6 each were prepared in the same manner as the above, except that a monomer and its composition was varied as afore-described.

Preparation example 2:

Preparation of fine composite polymer particles L-6

To 1000 ml four-necked flask provided with a stirrer, thermometer, dropping funnel, nitrogen gas-introducing tube and reflux condenser was introduced nitrogen gas to remove oxygen and then 360 cc of distilled water and 126 g of 30 wt. % colloidal silica dispersion (mean particle size, 12 nm) were added thereto and heated until an internal temperature reached 80° C. 1.3 g of dextran sulfate, as a dispersing agent and 0.023 g of ammonium persulfate, as an initiator were added and then added 15 g of 2-ethylhexylacrylate to continue the reaction further for 4 hrs. Thereafter, the reaction mixture was cooled and adjusted to the pH of 6 with an aqueous solution of sodium hydroxide to obtain the composite polymer particles L-6.

Preparation example 3:

Preparation of comparative fine composite polymer particles HL-1

To 1000 ml four-necked flask provided with a stirrer, thermometer, dropping funnel, nitrogen gas-introducing tube and reflux condenser was introduced nitrogen gas to remove oxygen and then 360 cc of distilled water and 117 g of 30 wt. % colloidal silica dispersion (mean particle size, 12 nm) were added thereto and heated until an internal temperature reached 30° to 70° C. 0.5 g of sodium laurylsulfonate, as a dispersing agent and 0.08 g of ammonium persulfate and 0.03 g of sodium hydrogen sulfite, as an initiator were added and then added 15 g of 2-ethylhexylacrylate to continue the reaction further for 4 hrs. Thereafter, the reaction mixture was cooled and adjusted to the pH of 6 with an 4% aqueous ammonium solution to obtain comparative composite polymer particles HL-1.

Comparative composite polymer particles HL-2 were prepared in a similar manner.

| No. | Hydrophobic polymer compd. | Fine inorganic particles (wt. %, based on polymer) |
|---|---|---|
| HL-1 | 2-Ethylhexylacrylate | Colloidal silica (233) |
| HL-2 | Butylacrylate | Colloidal silica (233) |

Inventive composite polymer particles L-1 to 6, comparative composite polymer particles HL-1 and 2 and acrylate resin composite polymers DV-759 (30% by weight, based on silica) and DV-804 (100% by weight, based on silica), which were produced by Dainippon Ink Corp. and commercially available as Boncoat DV-series were subjected to the following evaluation.

Evaluation of chemical stability

To a composite polymer particle dispersion with a solid component of 10% by weight was added 10 g of 1M aqueous sodium chloride solution. After being allowed to stand, stability of the solution was visually evaluated according to the following criteria:

5; Highly stable 4; Stable 3; Slightly unstable 2; Occurrence of coagulation 1; Considerable coagulation.

| | | | |
|---|---|---|---|
| L-1 | 5 | HL-1 | 1 |
| L-2 | 5 | HL-2 | 1 |
| L-3 | 4 | DV-759 | 1 |
| L-4 | 4 | DV-804 | 1 |
| L-5 | 5 | | |
| L-6 | 4 | | |

As can be seen from the above, inventive fine composite polymer particles were shown to be excellent in chemical stability.

Evaluation of crack resistance

On a previously subbed polyethylene terephthalate transparent support with a thickness of 100 μm, an aqueous solution containing composite polymer particles of 3.3% by weight and gelatin of 6.7% by weight was coated so as to form dry thickness of 6 μm and dried to prepare a sample. after being allowed to stand at 55° C. and for 24 hrs. in a desiccator having silica gel desiccant, each sample was visually evaluated with respect to crack, based on the following criteria:

5; No occurrence of crack

4; Slight occurrence of crack

3; Appreciable occurrence of crack

2; Marked occurrence of crack

1; Overall occurrence of crack

Results thereof are shown as below.

| | Colloidal silica content (wt. %, based on total binder) | Crack resistance |
|---|---|---|
| L-1 | 25 | 5 |
| L-2 | 25 | 5 |
| L-3 | 25 | 4 |
| L-4 | 25 | 5 |
| L-5 | 25 | 4 |
| L-6 | 25 | 4 |
| HL-1 | 23 | 1 |
| HL-2 | 23 | 1 |
| DV-759 | 8 | 3 |
| DV-804 | 17 | 2 |

Example 2

Preparation of silver halide emulsion coating solution E-1

To the following Solution A were added Solutions B and C by double jet method over a period of 11 min., while being maintained at 40° C., at a pH of 3.0 with nitric acid and at a silver potential ($E_{Ag}$) of 170 mV with 1N. NaCl aqueous solution.

| | |
|---|---|
| Solution A | |
| Gelatin | 5.6 g |
| $HO(CH_2CH_2O)_n(CH_2CH_2CH_2O)_{17}(CH_2CH_2O)_mH$ (m + n = 6) 10% ethanol solution | 0.56 ml |
| Sodium chloride | 0.12 g |
| Concentrated nitric acid | 0.34 ml |
| Distilled water | 445 ml |
| Solution B | |
| Silver nitrate | 60 g |
| Concentrated nitric acid | 0.208 ml |
| Distilled water | 85.2 ml |
| Solution C | |
| Gelatin | 3 g |
| $HO(CH_2CH_2O)_n(CH_2CH_2CH_2O)_{17}(CH_2CH_2O)_mH$ (m + n = 6) 10% ethanol solution | 0.3 ml |
| Sodium chloride | 20.2 g |
| Sodium hexachloroiridate (1% aq. soln.) | 3.0 ml |
| Distilled water | 85.61 ml |
| Solution D | |
| Gelatin | 1.4 g |
| $HO(CH_2CH_2O)_n(CH_2CH_2CH_2O)_{17}(CH_2CH_2O)_mH$ (m + n = 6) 10% ethanol solution | 0.14 ml |
| Distilled water | 48.8 ml |

The resulting silver halide grains were proved to have an average grain size of 0.12 μm and monodispersion degree (standard deviation of grain size/average grain size) of 15%.

To the thus-prepared emulsion was added Solution D and the pH was adjusted to 6.0 with sodium carbonate and 20 mg of 4-hydroxy-6-methyl-1,3,3a,7-tetrazaindene was added thereto. Thereafter, the emulsion was desalting-washed and a fungicide solution E was added.

| | |
|---|---|
| Solution E | |
| 2-Methyl-5-chloroisothiazole-3-one | 15 ml |
| Water | 0.3 ml |

Subsequently, 200 mg of 4-hydroxy-6-methyl-1,3,3a,7-tetrazaindene, as a stabilizer and 8.6 g of gelatin were added, the following additives were added, and finally water was added to make the total amount of 303 ml. Thus, a coating solution of a silver halide emulsion (E-1) was obtained.

| | |
|---|---|
| Saponin 33% aqueous solution | 2.2 ml |
| Sodium dodecylbenzenesulfonate (20% aqueous solution) | 2.2 ml |
| Sodium 1-pentyl-2-(3-isopentyl)succinate-2-sulfonate (4% aqueous solution) | 0.3 ml |
| Hydrazine compound Hd (2% methanol soln.) | 7.5 ml |
| Amine compound Am (5% aqueous solution) | 4 ml |
| Citric acid (7% aqueous solution) | 0.4 ml |
| 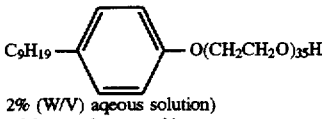 | 26.5 ml |
| 2% (W/V) aqeous solution) | |
| 2-Mercaptohypoxanthine (0.5% alkali aqueous solution) | 4 ml |
| Sodium ethylenediaminetetraacetate (5% aqueous solution) | 10 ml |
| Spirobis (3,3-dimethyl-5,6-dihydroxy-indane (5% methanol soln.) | 1.5 ml |
| Hydroquinone 20% aqueous solution | 2.5 ml |
| Styrenesulfonic acid/maleic acid copolymer (4% aqueous solution) | 4 ml |
| 2-Methyl-5-chloroisothiazole-3-one (5% methanol soln.) | 0.1 ml |

Hydrazine compound Hd

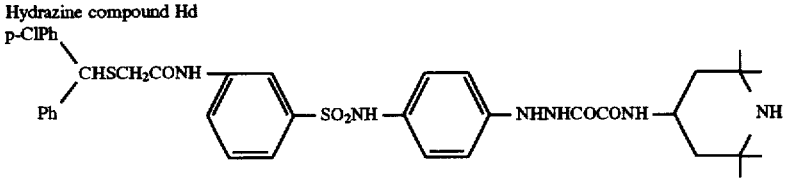

Amine compound Am

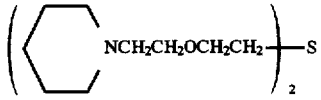

Preparation of coating solution for interlayer (M-1)

The following composition was made to the total amount of 1414 ml with water to prepare a coating solution M-1 for interlayer.

| | |
|---|---|
| Gelatin 12% aqueous solution | 250 ml |
| Saponin 33% aqueous solution | 12.3 ml |
| Sodium dodecylbenzenesulfonate (20% aqueous solution) | 12.3 ml |
| Citric acid 7% aqueous solution | 3 ml |
| 1-Phenyl-4-hydroxymethyl-4-methyl-3-pyrazolidone (dimezone S) 2% methanol soln. | 20 ml |
| Resorcin 20% aqueous solution | 40 ml |
| Gallic acid propyl ester 10% methanol soln. | 60 ml |
| Dye E 2% aqueous solution | 700 ml |
| Styrenesulfonic acid/maleic acid copolymer (4% aqueous solution) | 22.7 ml |
| 2-Bromo-2-nitro-1,3-propanediol (0.1% aqueous solution) | 6 ml |
| Dye dispersion Bu | 250 ml |

Preparation of protective layer coating solution P-1

The following composition was made up to the total amount of 1414 ml with water to prepare a protective layer coating solution P-1.

| | |
|---|---|
| Gelatin 12% aqueous solution | 250 ml |
| Sodium 1-decyl-2-(3-isopentyl)succinate-sulfonate 4% aqueous solution | 50 ml |
| Sodium chloride 10% aqueous solution | 22 ml |
| Amorphous silica (av. size, 3.5 mm) | 2 g |
| Amorphous silica (av. size, 6 mm) | 4 g |

-continued

| | |
|---|---|
| 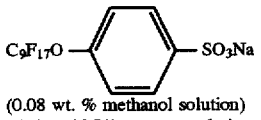 | 70 ml |
| (0.08 wt. % methanol solution) | |
| Citric acid 7% aqueous solution | 5.1 ml |
| Dimezone S 2% methanol solution | 20 ml |
| Dye E 2% aqueous solution | 700 ml |
| Styrenesulfonic acid/maleic acid copolymer 4% aqueous solution | 22.7 ml |
| 2-Bromo-2-nitro-1,3-propanediol 0.15 aqueous solution | 6 ml |
| Dye dispersion Bu | 250 ml |

Dye E

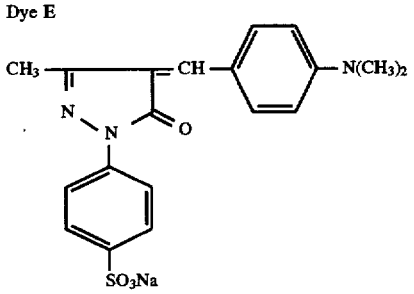

Preparation of Dye dispersion Bu

The following dye Se in an amount that gave a coating coverage of 100 mg/m$^2$ was dissolved in 200 ml of ethyl acetate. Gelatin of 30 g, citric acid of 147 mg, isopropylnaphthalenesulfonic acid of 400 mg and phenol of 3 g were dissolved in water of 250 ml. Both aqueous solutions were mixed and dispersed by a homogenizer. After removing ethyl acetate under reduced pressure and with heating, water was added to make 250 ml and the resulting dispersion was set with cooling to obtain a dye dispersion of solid particles having an average particle size of 0.20 mm.

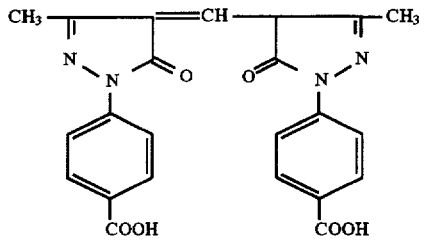

Dye Se

Preparation of hardener solution for in-line addition to interlayer

According to the following composition, there was prepared 300 ml of a hardener solution MH 1 to be added in-line to a interlayer coating solution immediately before coating.

| | |
|---|---|
| Hardener H1 10% aqueous solution | 260 ml |
| Water | 40 ml |
| hardener H1 | |

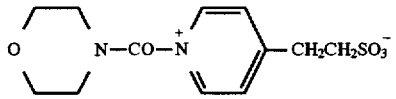

Preparation of hardener solution for in-line addition to protective layer PH 1

According to the following composition, there was prepared 300 ml of a hardener solution PH 1 to be added in-line to a protective layer coating solution immediately before coating.

| | |
|---|---|
| Hardener H2 2.5% aqueous solution | 187 ml |
| Water | 113 ml |
| Hardener H2 | |

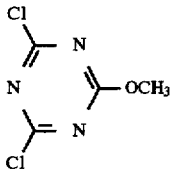

Preparation of backing layer-coating solution BC-1

The following composition was made up to the total amount of 895 ml with water to prepare a backing layer coating solution BC-1.

| | |
|---|---|
| Gelatin | 32.4 g |
| Dye C 6% aqueous solution | 696 ml |
| Dye D 5% aqueous solution | 64 ml |
| Saponin 33% aqueous solution | 24 ml |
| Polymer latex 20% emulsion (average particle size of 0.10 mm, copolymer of cyclohexyl methacrylate, isononyl acrylate, glycidyl acrylate and styrene-isoprene) | 6.6 ml |
| Zinc oxide 10% solid particle dispersion (average particle size 0.15 μm) | 10 ml |

-continued

| | |
|---|---|
| 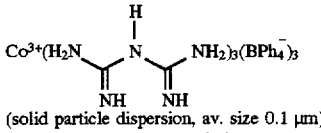 | 10 ml |
| (solid particle dispersion, av. size 0.1 μm) | |
| Citric acid 7% aqueous solution | 3.8 ml |
| Sodium styrenesulfonate 4% aq., soln. | 23 ml |

Dye C

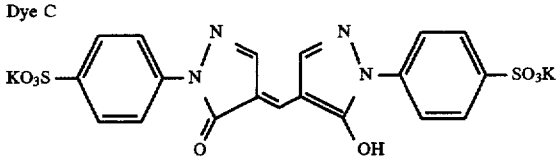

Dye D

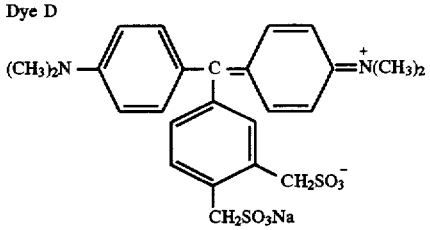

Preparation of backing protective layer-coating solution BC-2

The following composition was made up to the total amount of 711 ml with water to prepare a backing protective layer coating solution BC-2.

| | |
|---|---|
| Gelatin | 24.9 g |
| Water | 605 ml |
| Methyl methacrylate 2% dispersion (average size, 7 μm) | 72 ml |
| Sodium 1-decyl-2-(3-isopentyl)succinate-2-sulfonate 45% aqueous solution | 11 ml |
| Glyoxal 4% aqueous solution | 4 ml |

Preparation of hardener solution for in-line addition to backing layer BH 1

According to the following composition, there was prepared 30 ml of a hardener solution BH 1 to be added in-line to a backing layer coating solution immediately before coating.

| | |
|---|---|
| Water | 27.22 ml |
| Methanol | 1.5 ml |
| Hardener H3 | 1.28 ml |
| NaCl | 0.005 g |
| Hardener H3 | |

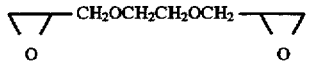

Preparation of Samples 1 through 11

On one side of polyethylene terephthalate transparent support with a thickness of 100 μm, both side of which were previously subbed, were simultaneously coated a coating solution E-1 of a silver halide emulsion layer in a dry gelatin weight of 1.0 g/m$^2$ and silver coverage of 3.5 g/m$^2$, interlayer-coating solution M-1 in a dry gelatin weight of 0.3 g/m$^2$ and protective layer-coating solution P-1 in a dry gelatin weight of 0.3 g/m$^2$ with addition of inventive fine composite polymer particles, while hardener solutions MH-1 and PH 1 were respectively added in-line to an interlayer coating solution and protective layer coating solution immediately before coating.

At the same time, on the other side of the support were simultaneously coated a backing layer-coating solution BC-1 in a dry gelatin weight of 1.8 g/m$^2$ and backing protective layer-coating solution BP-1 in a dry gelatin weight of 0.5 g/m$^2$, while a hardener solution BH 1 was added in-line to the backing layer-coating solution immediately before coating.

The temperature of a coating solution in its coating was 35° C. The coating layer was exposed to chill air for 6 sec. to be set and dried for 2 min. under the condition controlled so as to keep a dry bulb temperature of 35° C. or less and a surface temperature of the sample of 20° C. or less. Within 20 sec. after completion of drying, the sample was maintained at a dry bulb temperature of 50° C. and dew point of −5° C. for 50 sec. to prepare Samples No. 1 through 11.

Thus prepared samples were evaluated in the following manner.

Coating quality

Coated samples each were observed with a magnifier and evaluated with respect to coating quality by counting the number of coating defect with an area of 100 cm$^2$.

Photographic performance

Using a roomlight handling UV printer P-627 FA produced by Dainippon Screen Co., Ltd., a photographic material sample was exposed through a transparent film original with a thickness of 100 μm comprising halftone dots having a dot percentage of 50%, in contact with an emulsion side of the sample with suction and processed according to the following condition. Sensitivity of a fresh sample was relatively shown as a common logarithmic value of reciprocal of exposure time in second that gave halftone dots having a dot percentage of 50%, based on the sensitivity of Sample 1 being 100.

Processing condition:

| | | |
|---|---|---|
| Developing | 34° C. | 12 sec. |
| Fixing | 32° C. | 12 sec. |
| Washing | Ordinary temp. | 10 sec. |
| Drying | 40° C. | 10 sec. |

Developer:

| | |
|---|---|
| Water | 205.7 ml |
| Diethylenetriaminepentaacetic acid | 3.63 g |
| Sodium sulfite | 52.58 g |
| Boric acid | 8.0 g |
| Potassium bromide | 4.0 g |
| Potassium carbonate (49% aq., soln.) | 112.24 g |
| 2-Mercaptohypoxanthine | 0.07 g |
| Diethylene glycol | 40 g |
| Benzotriazole | 0.21 g |
| Hydroquinone | 20 g |
| Dimezone S | 0.85 g |
| 1-Phenyl-5-mercaptotetrazole | 0.03 g |
| Potassium hydroxide (48.55% aq., soln.) | 14 ml |

Water was added to make 1 liter (pH 10.4).

Fixer:

| | |
|---|---|
| Ammonium thiosulfate (70% aq., soln.) | 262 g |
| Water | 79 ml |
| Boric acid | 9.78 g |
| Sodium acetate | 38.5 g |
| Acetic acid (90% aq., soln.) | 13.28 g |
| Tartaric acid (50% aq., soln.) | 7.27 g |
| Aluminium sulfate aq., soln. ($Al_2O_3$-converted content 8.1%) | 26.5 g |

Water was added to make 1 liter (pH 4.85)

Evaluation of haze

Unexposed sample which was processed according to the above condition was measure with respect to haze by means of a turbidimeter, Model T-2600DA, product by Tokyo Denshoku Co., Ltd.

Evaluation of scratch resistance

After samples were developed, fixed and washed according to the above condition, they were again dipped into the developer for 30 sec. A sapphire needle with a radius of 0.3 mm was moved in the direction parallel to the emulsion-face with varying a pressure load of the sapphire needle in the range of 0 to 200 g and a minimum load that caused scratch to occur in the surface was determined.

Results thereof are shown in Table 1.

TABLE 1

| No. | Fine composite polymer: Emulsion layer (mg/m$^2$) | Fine composite polymer: Protective layer (mg/m$^2$) | Haze (%) | Coating quality (number/100 cm$^2$) | Sensitivity | Scratch (g) | |
|---|---|---|---|---|---|---|---|
| 1 | — | — | 7 | 1 | 100 | 21 | Comp. |
| 2 | HL-1 (500) | — | 10 | More than 100 | 83 | 17 | Comp. |
| 3 | HL-2 (500) | — | 16 | More than 100 | 85 | 19 | Comp. |
| 4 | DV-759 (500) | — | 26 | More than 100 | 80 | 10 | Comp. |
| 5 | — | DV-804 (500) | 23 | 82 | 79 | 16 | Comp. |
| 6 | L-1 (500) | — | 9 | 1 | 98 | 54 | Inv. |
| 7 | L-2 (500) | — | 8 | 1 | 99 | 56 | Inv. |
| 8 | L-3 (500) | — | 5 | 2 | 97 | 49 | Inv. |
| 9 | L-4 (500) | — | 4 | 3 | 97 | 45 | Inv. |
| 10 | L-5 | — | 8 | 2 | 98 | 51 | Inv. |

TABLE 1-continued

| No. | Fine composite polymer Emulsion layer (mg/m²) | Protective layer (mg/m²) | Haze (%) | Coating quality (number/100 cm²) | Sensitivity | Scratch (g) | |
|---|---|---|---|---|---|---|---|
| 11 | (500) — | L-6 (500) | 9 | 3 | 98 | 46 | Inv. |

As can been from the Table, the use of the fine composite polymer particles led to excellent results in photographic performance (sensitivity), film physical properties (haze, scratch) and coating quality.

Example 3

Preparation of emulsion Em-1

A tabular grain emulsion Em-1 was prepared in the following manner.

| | |
|---|---|
| Solution A1 | |
| Ossein gelatin | 24.2 g |
| water | 9657 ml |
| $HO(CH_2CH_2O)_n[CH(CH_3)CH_2O]_{17}(CH_2CH_2O)_mH$ (m + n = 5 to 7) 10% ethanol solution | 1.20 ml |
| Potassium bromide | 10.8 g |
| 10% Nitric acid | 160 ml |
| Solution B1 | |
| 2.5 N Silver nitrate aq., soln. | 2825 ml |
| Solution C1 | |
| Potassium bromide | 841 g |
| Water to make | 2825 ml |
| Solution D1 | |
| Ossein gelatin | 121 g |
| Water | 2040 ml |
| $HO(CH_2CH_2O)_n[CH(CH_3)CH_2O]_{17}(CH_2CH_2O)_mH$ (m + n = 5 to 7) 10% ethanol solution | 5.70 ml |
| Solution E1 | |
| 1.75 N Potassium bromide aq., soln. for $E_{ag}$-adjusting | |

To solution A1 at 35° C. with stirring by use of a mixing stirrer described in Japanese Patent No. 58-58288 were added solutions B1 and C1, each 475.0 ml, by double jet addition over a period of 2.0 min. to form nucleus grains. After completing addition, the temperature of the reaction mixture was raised to 60° C. by taking 60 min., then a total amount of solution D1 was added thereto and the pH was adjusted to 5.5 with KOH 3% aqueous solution. Subsequently, solutions B1 and C1 were added at a flow rate of 55.4 ml/min. over a period of 42 min., while a silver potential (which was measured by a silver ion selection electrode with reference to a saturated silver-silver chloride electrode) was controlled within a range of +8 mV to +30 mV. After completing the addition, the resulting emulsion was adjusted to the pH of 6.0 with KOH 3% aqueous solution and immediately subjected to desalinization-washing to obtain a seed grain-emulsion. As a result of microscopic observation of the emulsion, it was shown that not less than 90% of the total grain projected area was accounted for by hexagonal tabular grains with an adjacent edge ratio of 1.0 to 2.0, average thickness of 0.090 μm and average circle-equivalent diameter of 0.510 μm.

To the resulting seed grain emulsion at 53° C. were added in the form of a solid particle dispersion 450 mg of spectral sensitizing dye A [5,5'-dichloro-9-ethyl-3,3'-di-(3-sulfopropyl)oxacarbocyanine sodium salt anhydride] and 8 mg of spectral sensitizing dye B [5,5'-di-(butoxycarbonyl)-1,1'-di-ethyl-3,3'-di-(4-sulfobutyl) benzimidazolocarbocyanine sodium salt anhydride]. Subsequently, an aqueous solution containing 60 mg of 4-hydroxy-6-methyl-1,3,3a,7-tetrazaindene (TAI), 15 mg of adenine, 50 mg of ammonium thiocyanate, 2.5 mg of chloroauric acid and 5.0 mg of sodium thiosulfate, 5 mmol equivalent of a silver iodide fine grain emulsion (average size of 0.05 μm) and a dispersion of containing 6.0 mg of triphenyphosphine selenide were added and the emulsion was ripen over a period of 2 hr. 30 min. After completion of ripening was added 750 mg of TAI, as a stabilizer. The solid particle dispersion of the spectral sensitizing dye was prepared by adding the dye into water at 27° C. and stirring, for 30 to 120 min., by means of a high-speed stirrer (Dissolver) at 3500 r.p.m.

The dispersion of triphenylphosphine selenide was prepared in the following manner. Triphenylphosphine selenide of 120 g was dissolved in ethyl acetate of 30 kg at 50° C. On the other hand, gelatin of 3.8 kg was dissolved in water of 38 kg and was added thereto sodium dodecybenzenesulfonate 25 wt. % aqueous solution of 93 g. Both solutions were mixed and dispersed at 50° C. for 30 min. by means of a high-speed stirrer type dispersing machine provided with a dissolver with a diameter of 10 cm; thereafter the mixture was further stirred under reduced pressure to remove ethyl acetate until the residual concentration of ethyl acetate reached 0.3 wt. % or less. Water was added to the resulting dispersion to male a total amount of 80 kg.

Preparation of emulsion Em-2

Using emulsion Em-1 as a seed emulsion and the following solutions, tabular silver iodobromide grain emulsion Em-2 was prepared.

| | |
|---|---|
| Solution A2 | |
| Ossein gelatin | 19.04 |
| $HO(CH_2CH_2O)_n[CH(CH_3)CH_2O]_{17}(CH_2CH_2O)_mH$ (m + n = 5 to 7) 10% ethanol solution | 2.00 ml |
| potassium iodide | 7.00 g |
| Em-1 | 1.55 mol equivalent |
| Water to make | 2800 ml |
| Solution B2 | |
| Potassium bromide | 1493 g |
| water to make | 3585 ml |
| Solution C2 | |
| Silver nitrate | 2131 g |
| Water to make | 3585 ml |

-continued

| Solution D2 | |
|---|---|
| Fine grain emulsion* comprising gelatin of 3 wt. % and silver iodide fine grains (average size 0.05 μm) | 0.028 mol equivalent |

*The fine grain emulsion was prepared by adding an aqueous solution containing 7.06 mol of silver nitrate and aqueous solution containing 7.06 mol of potassium iodide, each 2 liters to 6.64 liters of aqueous gelatin 5.0 wt. % solution containing 0.06 mol of potassium iodide by taking 10 min., while the pH was maintained at 2.0 with nitric acid and the temperature was kept at 40° C. After forming grains, the pH was adjusted to 6.0.

To a reaction vessel containing solution A2 at 55° C., solutions B2 and C2, each, half amount thereof were added with vigorous stirring, while the pH was kept at 5.8. The pH was raised to 8.8 with 1% KOH aqueous solution and solutions B2 and C2 and solution D2 were simultaneously added until all of solution D2 was added. The pH was adjusted to 6.0 with citric acid 0.3% aqueous solution and residual solutions B2 and C2 were further added by double jet addition, taking 25 min, while the pAg was kept at 8.9. The flow rate of solutions B2 and C2 was acceleratedly varied in response to a critical growth rate so as to prevent from polydispersion due to nucleation and Ostwald ripening.

After completing addition, the emulsion was desalted and redispersed and then the pH and pAg were respectively adjusted to 5.80 and 8.2 at 40° C. As a result of electron-microscopic observation, the resulting emulsion was proved to be comprised of tabular silver halide grains with an average circle-equivalent diameter of 0.91, an average thickness of 0.23 μm, an average aspect ratio of 4.0 and grain size distribution width (standard deviation of grain size/average grain size) of 20.5%.

To the resulting seed grain emulsion at 47° C. were added a silver iodide fine grain emulsion (average grain size of 0.05 μm), 390 mg of spectral sensitizing dye A and 4 mg of spectral sensitizing dye, each in the form of a solid particle dispersion. Subsequently, an aqueous solution containing 10 mg of adenine, 50 mg of ammonium thiocyanate, 2.0 mg of chloroauric acid and 3.3 mg of sodium thiosulfate, 5 mmol equivalent of a silver iodide fine grain emulsion (average size of 0.05 μm) and a dispersion of containing 4.0 mg of triphenyphosphine selenide were added and the emulsion was ripen over a period of 2 hr. 30 min. After completion of ripening was added 750 mg of TAI, as a stabilizer.

Thus prepared emulsions Em-1 and 2 were blended in a ratio by weight of 6:4. Using the blended emulsion, photographic material Samples No.12 through 22 were prepared according to the following formulas.

Preparation of Samples No.12 through 22

On both sides of polyethylene terephthalate film base blue-tinted with a density of 0.15 and having a thickness of 175 μm, the following cross-over cut layer, emulsion layer, interlayer and protective layer were coated in this order from the base so as to have a silver coverage of 1.8 g/m$^2$, protective layer gelatin amount of 0.4 g/m$^2$, interlayer gelatin amount of 0.4 g/m$^2$, emulsion layer gelatin amount of 1.5 g/m$^2$ and cross-over cut layer gelatin amount of 0.2 g/m$^2$ (each per one side) and dried to prepare Sample No.12.

| First layer (Cross-over cut layer) | |
|---|---|
| Solid particle dispersion of dye AH | 180 mg/m$^2$ |
| Gelatin | 0.2 g/m$^2$ |
| Sodium dodecylbenzenesulfonate | 5 mg/m$^2$ |
| Compound I | 5 mg/m$^2$ |
| Latex L | 0.2 g/m$^2$ |
| 2,4-Dichloro-6-hydroxy-1,3,5-triazine sodium salt | 5 mg/m$^2$ |
| Colloidal silica (av. size 0.014 μm) | 10 mg/m$^2$ |
| **Second layer (Emulsion layer)** | |
| Silver halide emulsion Silver amount, | 1.8 g/m$^2$ |
| Compound G | 0.5 mg/m$^2$ |
| 2,6-Bis(hydroxyamino)-4-diethylamino-1,3,5-triazine | 5 mg/m$^2$ |
| t-Butyl-catechol | 130 mg/m$^2$ |
| Polyvinyl pyrrolidone (M.W. 10,000) | 35 mg/m$^2$ |
| Styrene-anhydrous maleic acid copolymer | 80 mg/m$^2$ |
| Sodium polystyrenesulfonate | 80 mg/m$^2$ |
| Trimethylolpropane | 350 mg/m$^2$ |
| Diethylene glycol | 50 mg/m$^2$ |
| Nitrophenyl-triphenyl-phosphonium chloride | 20 mg/m$^2$ |
| Ammonium 1,3-dihydroxybenzene-4-sulfonate | 500 mg/m$^2$ |
| Sodium 2-mercaptobenzimidazole-5-sulfonate | 5 mg/m$^2$ |
| Compound H | 0.5 mg/m$^2$ |
| $n\text{-}C_4H_9OCH_2CH(OH)CH_2N(CH_2COOH)_2$ | 350 mg/m$^2$ |
| COMPOUND M | 5 mg/m$^2$ |
| Compound N | 5 mg/m$^2$ |
| Colloidal silica | 0.5 mg/m$^2$ |
| Latex L | 0.2 mg/m$^2$ |
| Dextrin (av. M.W. 1000) | 0.2 mg/m$^2$ |
| Compound P | 0.2 mg/m$^2$ |
| Compound Q | 0.2 mg/m$^2$ |
| **Third layer (Interlayer)** | |
| Gelatin | 0.4 g/m$^2$ |
| Formaldehyde | 10 m g/m$^2$ |
| 2,4-Dichloro-6-hydroxy-1,3,5-triazine sodium salt | 5 mg/m$^2$ |
| Bis-vinylsulfonylmethyl ether | 18 m g/m$^2$ |
| Latex L | 0.05 g/m$^2$ |
| Poly(sodium acrylate) | 10 m g/m$^2$ |
| Compound S-1 | 3 m g/m$^2$ |
| Compound K | 5 m g/m$^2$ |
| Hardener B | 1 mg/m$^2$ |
| **Fourth layer (Protective layer)** | |
| Gelatin | 0.4 g/m$^2$ |
| Matting agent of polymethyl methaacrylate (area-averaged particle size 7.0 μm) | 50 mg/m$^2$ |
| Formaldehyde | 10 mg/m$^2$ |
| 2,4-Dichloro-6-hydroxy-1,3,5-triazine sodium salt | 5 mg/m$^2$ |
| Bis-vinylsulfonylmethyl ether | 18 mg/m$^2$ |
| Latex L | 0.1 g/m$^2$ |
| Polyacrylamide (av. M.W. 10000) | 0.05 g/m$^2$ |
| Polyacrylic acid sodium salt | 20 mg/m$^2$ |
| Polysiloxane S1 | 20 mg/m$^2$ |
| Compound I | 12 mg/m$^2$ |
| Compound J | 2 mg/m$^2$ |
| Compound S-1 | 7 mg/m$^2$ |
| Compound K | 15 mg/m$^2$ |
| Compound O | 50 mg/m$^2$ |
| Compound S-2 | 5 mg/m$^2$ |
| $C_9F_{19}O(CH_2CH_2O)_{11}H$ | 3 mg/m$^2$ |
| $C_8F_{17}SO_2N(C_3H_7)\text{—}(CH_2CH_2O)_{15}H$ | 2 mg/m$^2$ |
| $C_8F_{17}SO_2N(C_3H_7)\text{—}(CH_2CH_2O)_4\text{—}(CH_2)_4SO_3Na$ | 1 mg/m$^2$ |
| Hardener B | 1.5 mg/m$^2$ |

Samples 13 to 22 were prepared in the same manner as Sample 12, except that fine composite polymer particles were added, as shown in table 2.

Dye AH in the form of a solid fine particle dispersion

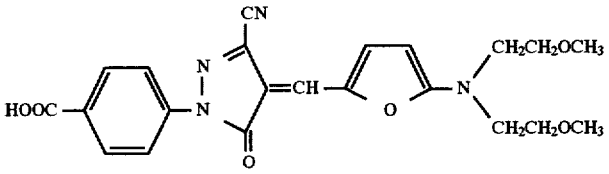
Compound I
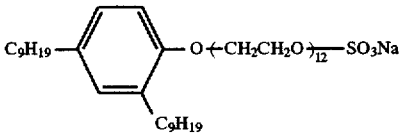
Latex L
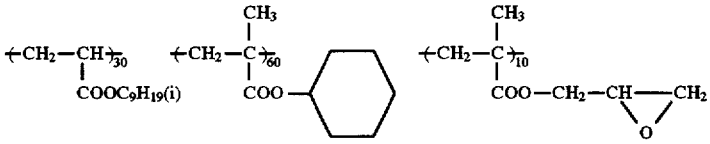
Hardener A
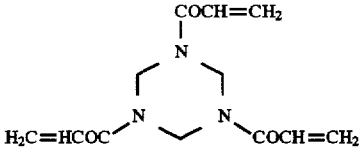
Compound G
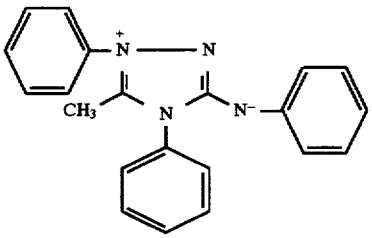
Compound H
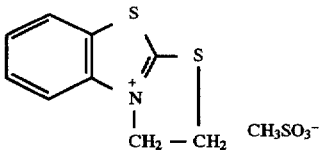
Compound M
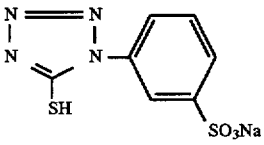
Compound N
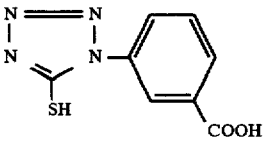
Compound P -continued

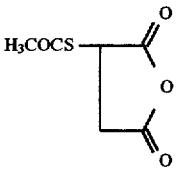

Compound Q

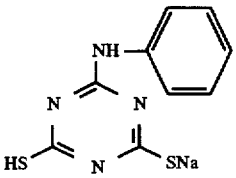

Compound S-1

$NaO_3S-CH(CH_2COOC_9H_{19})COO(CH_2)_2CH(CH_3)_2$

Compound K

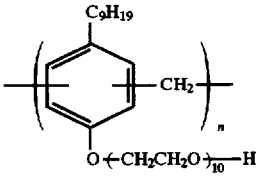

Mixture with n = 2~5

Hardener B

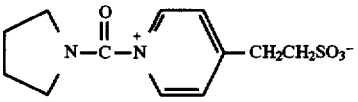

Polysiloxane S1

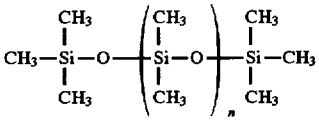

n ≈ ~1000

Compound J

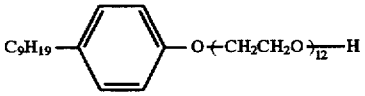

Compound o $C_{11}H_{23}CONH(CH_2CH_2O)_5H$

Compoud S-2

$NaO_3S-CH(CH_2COOCH_2(C_2F_4)_3H)COOCH_2(C_2F_4)_3H$

Evaluation

Thus prepared samples were evaluated with respect to photographic performance, antistatic property and film physical property, as follows.

Photographic performance:

The photographic material sample which was laminated with fluorescent intensifying screen prepared in the manner as described below, was exposed to X-ray through Penetrometer type B (product by Konica Corp.) and processed using an automatic processor SRX-503 and processing solution SR-DF (both products by Konica Corp.), in which processing was conducted at a developing temperature of 35° C. and over a period of 45 sec. (dry to dry). Sensitivity was relatively shown as reciprocal of X-ray exposure necessary to give a density of 1.0, based on the sensitivity of sample No.12 being 100.

Preparation of fluorescent intensifying screen:

To the composition as described below was added methylethylketone as a solvent and the mixture was dispersed by a propeller type mixer to prepare a coating solution for forming a fluorescent substance with a viscosity of 25 ps at 25° C. (binder/fluorescent substance=1/22).

| | |
|---|---|
| $Gd_2O_2S$:Tb fluorescent substance (av. grain size 1.8 μm) | 200 g |
| Polyurethane type thermoplastic elastomer [product by Sumitomo-Beyer Urethane Co., Ltd. Demolac TPKL-5-2625 solid component 40%)] | 20 g |
| Nitrocellulose (nitration degree 11.5%) | 2 g |

As a coating solution for forming a sublayer, to soft acrylate resin of 90 g (solid component) and nitrocellulose of 50 g was added methylethylketone and the mixture was dispersed to prepare a dispersion with a viscosity of 3 to 6 ps )25° C.).

Polyethylene terephthalate support compounded with titanium dioxide and with a thickness of 250 μm was horizontally placed on glass plate, and thereon was coated the above sublayer coating solution by a doctor blade and dried with slowly raising a temperature from 25° to 100° C. to form a sublayer with a thickness of 15 μm. Further thereon, the coating solution for forming the fluorescent substance was coated by a doctor blade to form a coating layer with a thickness of 240 μm and after drying, compression was conducted using a calender roll at a pressure of 800 kgw/cm$^2$ and a temperature of 80° C. Furthermore, according to the method described in Example 1 of JP-A 6-75097, a transparent protective layer with a thickness of 3 μm was formed to prepare an intensifying screen comprising the support, sublayer, fluorescent substance layer, and transparent protective layer.

Test for occurrence of static mark:

Unexposed photographic material samples were placed on a rubber sheet, pressed with a rubber roll, pealed apart and subjected to processing. Occurrence of static mark was visually evaluated, based on the following criteria.

A: No occurrence of static mark

B: Slight occurrence of static mark

C: Appreciable occurrence of static mark

D: Marked occurrence of static mark

E: Overall occurrence of static mark

Evaluation of resistance to crack:

After being allowed to stand at 55° C. and for 24 hrs. in a desiccator having silica gel desiccant, unexposed samples each were visually evaluated with respect to crack, based on the following criteria:

A: No occurrence of crack

B: Slight occurrence of crack

C: Appreciable occurrence of crack

D: Marked occurrence of crack

E: Overall occurrence of crack

With respect to coating quality and scratch, evaluation was conducted in the same manner as in Example 2.

Results thereof are shown in Table 2.

TABLE 2

| | Fine composite polymer | | | | | | | |
|---|---|---|---|---|---|---|---|---|
| No. | Emulsion layer (mg/m$^2$) | Protective layer (mg/m$^2$) | Static mark | Coating quality (number/100 cm$^2$) | Sensitivity | Scratch (g) | Crack resistance | |
| 12 | — | — | A | 1 | 100 | 15 | A | Comp. |
| 13 | HL-1 (500) | — | D | 100 or more | 82 | 15 | E | Comp. |
| 14 | — | HL-2 (500) | E | 76 | 89 | 14 | D | Comp. |
| 15 | — | DV-759 (500) | D | 89 | 79 | 10 | B | Comp. |
| 16 | DV-804 (500) | — | E | 100 or more | 78 | 13 | C | Comp. |
| 17 | L-1 (500) | — | A | 0 | 97 | 56 | A | Inv. |
| 18 | L-2 (500) | — | A | 1 | 98 | 53 | A | Inv. |
| 19 | L-3 (500) | — | A | 2 | 95 | 50 | A | Inv. |
| 20 | — | L-4 (500) | B | 1 | 96 | 45 | A | Inv. |
| 21 | L-5 (500) | — | A | 4 | 95 | 52 | B | Inv. |
| 22 | — | L-6 (500) | B | 3 | 98 | 46 | B | Inv. |

As can be seen from the Table, photographic material samples by use of the inventive fine composite polymer particles were shown to be superior not only in photographic performance )sensitivity), film physical properties (scratch, crack resistance) and coating quality (no streak due to solidifying) but also in antistatic property.

What is claimed is:

1. An image recording material comprising composite polymer particles which comprise inorganic particles and a hydrophobic polymer compound containing a repeating unit represented by the following formula (1) and said inorganic particles being contained, in said composite polymer particles, in an amount of 30 to 1000% by weight, based on the hydrophobic polymer compound:

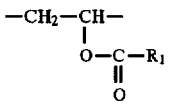

formula (1)

wherein $R_1$ is a substituent.

2. The image recording material of claim 1, wherein said hydrophobic polymer compound contains the repeating unit represented by formula (1) in an amount of at least 45% by weight.

3. The image recording material of claim 1, wherein $R_1$ of formula (1) is an alkyl group having 1 to 12 carbon atoms.

4. The image recording material of claim 3, wherein $R_1$ is a t-butyl group.

5. The image recording material of claim 1, wherein said inorganic particles comprise an oxide of Si, Na, K, Ca, Ba, Al, Zn, Fe, Cu, Sn, In, W, Y, Sb, Mn, Ga, V, Nb, Tu, Ag, Bi, B, Mo, Ce, Cd, Mg, Be or Pb.

6. The image recording material of claim 5, wherein said oxide is selected from the group consisting of $SiO_2$, $TiO_2$, Zno, $SnO_2$, $MnO_2$, $Fe_2O_3$, $ZnSiO_4$, $Al_2O_3$, $BeSiO_4$, $Al_2SiO_5$, $ZrSiO_4$, $CaWO_4$, $CaSiO_3$, $InO_2$, $SnSbO_2$, $Sb_2O_5$, $Nb_2O_5$, $Y_2O_3$, $CeO_2$ and $Sb_2O3_3$.

7. The image recording material of claim 6, wherein said oxide is colloidal silica.

8. The image recording material of claim 1, wherein said image recording material is a silver halide photographic light sensitive material comprising a support having thereon photographic component layers including a light sensitive silver halide emulsion layer and a light insensitive hydrophilic colloidal layer, at least one of the component layers comprising said composite polymer particles which comprise inorganic particles and the hydrophobic polymer compound as claimed in claim 1.

9. The image recording material of claim 8, wherein said inorganic particles comprise an oxide of Si, Y, Sn, Ti, Al, V, Sb, In, Mn, Ce or B.

10. The image recording material of claim 1, wherein said composite polymer particles are formed by polymerizing, in the presence of said fine inorganic particles, a composition containing a hydrophobic monomer represented by the following formula (2):

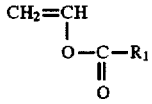

formula (2)

wherein $R_1$ has the same definition as in claim 1.

11. The image recording material of claim 8, wherein said composition contains said monomer represented by formula (2), in an amount of not less than 45% by weight of total monomers contained in the composition.

12. The image recording material of claim 2, wherein $R_1$ of formula (1) is an alkyl group having 1 to 12 carbon atoms.

13. The image recording material of claim 12, wherein said inorganic particles comprise an oxide of Si, Na, K, Ca, Ba, Al, Zn, Fe, Cu, Sn, In, W, Y, Sb, Mn, Ga, V, Nb, Tu, Ag, Bi, B, Mo, Ce, Cd, Mg, Be or Pb.

14. The image recording material of claim 13, wherein said oxide is selected from the group consisting of $SiO_2$, $TiO_2$, ZnO, $SnO_2$, $MnO_2$, $Fe_2O_3$, $ZnSiO_4$, $Al_2O_3$, $BeSiO_4$, $Al_2SiO_5$, $ZrSiO_4$, $CaWO_4$, $CaSiO_3$, $InO_2$, $SnSbO_2$, $Sb_2O_5$, $Nb_2O_5$, $Y_2O_3$, $CeO_2$ and $Sb_2O_3$.

15. The image recording material of claim 14, wherein said oxide is colloidal silica and $R_1$ is a t-butyl group.

* * * * *